US011123744B2

(12) United States Patent
Sabol et al.

(10) Patent No.: US 11,123,744 B2
(45) Date of Patent: Sep. 21, 2021

(54) PERFORATED ROTARY CUTTER

(71) Applicant: SULZER MANAGEMENT AG, Winterthur (CH)

(72) Inventors: Rob Sabol, Aliso Viejo, CA (US); Corey Glauberman, Tustin, CA (US); Daniel McHugh, New Prague, MN (US); Todd Nydam, Newport Beach, CA (US); John Schatzlein, Garden Grove, CA (US)

(73) Assignee: SULZER MANAGEMENT AG, Winterthur (CH)

( * ) Notice: Subject to any disclaimer, the term of this patent is extended or adjusted under 35 U.S.C. 154(b) by 847 days.

(21) Appl. No.: 14/862,226

(22) Filed: Sep. 23, 2015

(65) Prior Publication Data

US 2016/0082444 A1 Mar. 24, 2016

Related U.S. Application Data

(60) Provisional application No. 62/054,643, filed on Sep. 24, 2014.

(51) Int. Cl.
*B02C 18/14* (2006.01)
*B02C 18/00* (2006.01)
(Continued)

(52) U.S. Cl.
CPC ..... *B02C 18/142* (2013.01); *B02C 18/0092* (2013.01); *B02C 18/16* (2013.01); *B02C 18/182* (2013.01)

(58) Field of Classification Search
CPC ... B02C 18/0092; B02C 18/16; B02C 18/142; B02C 18/182
(Continued)

(56) References Cited

U.S. PATENT DOCUMENTS 744,296 A * 11/1903 Condula
1,551,875 A * 9/1925 Hall ..... B02C 4/30 241/227
(Continued)

FOREIGN PATENT DOCUMENTS

CN 201474028 U 5/2010
CN 201768598 U 3/2011

OTHER PUBLICATIONS

International Search Report and Written Opinion dated Jan. 6, 2016, issued by the International Searching Authority in corresponding International Application No. PCT/US15/51584.
(Continued)

*Primary Examiner* — Shelley M Self
*Assistant Examiner* — Smith Oberto Bapthelus
(74) *Attorney, Agent, or Firm* — Sughrue Mion, PLLC

(57) ABSTRACT

An apparatus for comminuting solid waste material is provided an includes a casing defining a comminution chamber and being open on opposite sides thereof for permitting the flow of liquid therethrough and a comminutor assembly including cooperating substantially parallel first and second shredding stacks. The comminutor assembly includes first and second parallel shafts rotabably mounted, each including a plurality of cutting elements mounted on said first shaft in interspaced relationship with a plurality of second cutting elements mounted on said second shaft, the cutting elements being positioned between and separated in an axial direction by spacers which are coplanar with the cutting elements of the adjacent stack such that a cutting element from one stack and a spacer from the other stack form a pair of interactive shredding members, wherein the at least one cutting tooth has a plurality of serrations, a tapered profile or a bi-level profile.

6 Claims, 7 Drawing Sheets

(51) Int. Cl.
*B02C 18/16* (2006.01)
*B02C 18/18* (2006.01)

(58) Field of Classification Search
USPC ..... 241/46.6, 236, 294–295
See application file for complete search history.

(56) References Cited

U.S. PATENT DOCUMENTS 3,578,252 A * 5/1971 Brewer ..... B02C 18/142 241/141
3,630,820 A * 12/1971 Leach ..... B26D 1/38 156/39
4,009,838 A * 3/1977 Tashman ..... B02C 13/286 241/99
4,046,324 A 9/1977 Chambers
4,068,805 A * 1/1978 Oswald ..... B02C 18/0007 241/159
4,239,160 A * 12/1980 Hawkins ..... B02C 18/186 241/222
4,607,800 A 8/1986 Barclay
4,627,582 A 12/1986 Goldhammer
4,669,673 A * 6/1987 Lodovico ..... B02C 19/0081 241/158
4,754,933 A * 7/1988 Leuthold ..... B02C 18/0007 241/100
5,048,764 A * 9/1991 Flament ..... B02C 18/0092 241/222
5,048,767 A * 9/1991 Mori ..... B02C 18/0007 241/236
5,141,168 A * 8/1992 Pepper ..... B02C 18/182 241/236
5,292,078 A * 3/1994 Lodovico ..... B02C 19/0081 241/167
5,295,633 A * 3/1994 Kimbro ..... B02C 18/0007 241/166
5,510,076 A * 4/1996 Brooks ..... B02C 18/142 209/38
5,511,732 A * 4/1996 Kroger ..... B02C 18/0007 241/166
5,676,321 A * 10/1997 Kroger ..... B02C 18/182 241/236
5,904,305 A * 5/1999 Kaczmarek ..... B02C 18/14 241/157
5,911,374 A * 6/1999 Biehn ..... B02C 18/142 241/236
6,260,780 B1 * 7/2001 Kroger ..... B02C 18/0007 241/236
6,343,755 B1 * 2/2002 Barclay ..... B02C 18/142 241/236
6,439,486 B1 * 8/2002 Nitta ..... B02C 1/04 241/159
6,983,903 B2 * 1/2006 Chang ..... B02C 18/0007 241/236
7,048,215 B2 * 5/2006 Irwin ..... B02C 18/142 241/236
7,172,147 B2 * 2/2007 Diemunsch ..... B02C 18/184 241/236
7,311,279 B2 * 12/2007 Mathers ..... B02C 18/142 241/166
7,938,347 B2 * 5/2011 Romanovich ..... B02C 18/142 241/101.4
8,418,947 B2 * 4/2013 Chan ..... B02C 18/0007 241/236
8,968,346 B2 * 3/2015 Lockard ..... A61B 17/221 606/170
2004/0159725 A1 * 8/2004 Irwin ..... B02C 18/142 241/73
2008/0117782 A1 * 5/2008 Ito ..... G11B 5/0245 369/53.21
2008/0197221 A1 * 8/2008 Hartnett ..... B02C 18/0007 241/91
2008/0265072 A1 * 10/2008 Wang ..... B02C 18/0007 241/220
2010/0010525 A1 * 1/2010 Lockard ..... A61B 17/32002 606/170
2010/0170970 A1 * 7/2010 Romanovich ..... B02C 18/142 241/26
2010/0181405 A1 * 7/2010 Bouwhuis ..... B02C 18/0007 241/236
2011/0192925 A1 * 8/2011 Pagaza-Melero ..... B26D 3/005 241/159
2012/0032014 A1 * 2/2012 Wang ..... B02C 18/0007 241/296
2013/0015280 A1 * 1/2013 Tamaki ..... B02C 18/0007 241/236
2015/0273477 A1 * 10/2015 Chen ..... B21D 39/03 241/292.1
2016/0082443 A1 * 3/2016 Nydam ..... B02C 18/0092 241/46.06
2016/0082444 A1 * 3/2016 Sabol ..... B02C 18/142 241/46.06

OTHER PUBLICATIONS

Communication dated May 9, 2018 issued by the State Intellectual Property Office of the People's Republic of China in counterpart application No. 201580050704.2.
Communication dated Feb. 11, 2019, from State Intellectual Property Office of the P.R.C. in counterpart application No. 201580050704.2.

* cited by examiner

PERFORATED ROTARY CUTTER

CROSS-REFERENCE TO RELATED PATENT APPLICATIONS

This application claims the benefit of U.S. Provisional Patent Application No. 62/054,643 filed on Sep. 24, 2014 in the U.S. Patent Trademark Office, the disclosure of which is incorporated herein in its entirety by reference.

BACKGROUND OF THE INVENTION

1. Field of the Invention

Twin-shafted grinders are commonly used for solids particle size reduction in various municipal wastewater applications. Cutters, or knives, stacked on counter-rotating shafts "grind" or "shred" materials ranging from feminine sanitary products to rock. The geometry of the cutters and the shaft speeds affect the particle size and throughput produced by the machine.

2. Description of the Related Art

Starting in the late 2000s, non-dispersible wipes (sheets) and paper products started becoming more and more prevalent in municipal wastewater. Common cutter designs have proven reasonably effective at shredding friable materials, such as wood, tampon applicators and shoes, however, when shredding fibrous materials such as non-dispersible wipes, fabric, and paper, these configurations often produce strips that tend to reweave in the waste stream when combined with a binder, such as hair. Comminuting systems with counter-rotating cutter elements have been used for years to reduce waste water solids in order to protect downstream equipment such as pumps. Smaller particles have a lessor chance of re-weaving into larger clumps which could damage or reduce the efficiency of equipment. Thus, an aspect of this application is to shred these fibrous items into strips of controlled lengths having reduced widths.

In the related art as shown in FIG. 7, the counter-rotating cutter stacks 44 and 46 comprise an alternating sequence of cutting elements 48 and spacers 50 fitted over a shaft 5, 68. The overlap and counter-rotation occurring in zone 52 shreds the material as it passed through the cutter elements.

SUMMARY OF THE INVENTION

According to an aspect of the present invention, there is provided an apparatus for comminuting solid waste material including a casing defining a comminution chamber and being open on opposite sides thereof for permitting the flow of liquid therethrough bearing solid waste material and being adapted for connection in a solid waste disposal line and a comminutor assembly including cooperating substantially parallel first and second shredding stacks.

The comminutor assembly including first and second parallel shafts rotabably mounted, each including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members. The cutting tooth having a plurality of serrations.

The serrations may be formed on leading edge of the cutter tooth and extend along a gullet of the cutter tooth. The spacers adjacent the cutting elements in the other stack have a cylindrical outer profile.

According to another aspect, serrations are formed on an outer circumferential surface of the cutting teeth of the cutting elements to extend along the outer circumferential surface. The spacers adjacent the cutting elements in the other stack may be formed with a plurality of grooves configured to interleave with the corresponding serrations formed along the outer circumferential surface of the cutting teeth of the cutter elements.

According to another aspect, there is provided an apparatus for comminuting solid waste material including a casing defining a comminution chamber and being open on opposite sides thereof for permitting the flow of liquid therethrough bearing solid waste material and being adapted for connection in a solid waste disposal line, and a comminutor assembly including cooperating substantially parallel first and second shredding stacks.

The comminutor assembly includes first and second parallel shafts rotabably mounted, each including a plurality of cutting elements mounted on said first shaft in interspaced relationship with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that a cutting element from one stack and a spacer from the other stack form a pair of interactive shredding members. The outer surface of the cutting teeth of the cutter elements are formed with a bi-level profile to form an outer facing outer surface and an outer facing inner surface disposed radially inward of the outer surface.

According to another aspect, the spacers adjacent the cutting elements in the other stack are formed with a bi-level outer profile configured to interleave with the bi-level profile of the cutting elements. Additionally, serrations may be formed on a leading edge of the cutter tooth and extend along a gullet of the cutter tooth.

According to another aspect, there is provided an apparatus for comminuting solid waste material including a casing defining a comminution chamber and being open on opposite sides thereof for permitting the flow of liquid therethrough bearing solid waste material and being adapted for connection in a solid waste disposal line, and a comminutor assembly including cooperating substantially parallel first and second shredding stacks.

The comminutor includes first and second parallel shafts rotabably mounted, each including a plurality of cutting elements mounted on said first shaft in interspaced relationship with a plurality of second cutting elements mounted on said second shaft, each of said cutting elements having cutter teeth thereon, said cutting elements being positioned between and separated in an axial direction by spacers which are coplanar with the cutting elements of the adjacent stack such that a cutting element from one stack and a spacer from the other stack form a pair of interactive shredding members. The cutter teeth are formed with a tapered outer profile, the tapered profile being tapered along an axial direction of the outer circumference of the cutting elements.

According to another aspect, the spacers adjacent the cutting elements in the other stack have a tapered profile to interleave with the adjacent cutting elements.

According to another aspect, the cutter teeth are formed with a dual tapered outer profile, the tapered outer profile being tapered along an axial direction of the outer circumference of the cutting elements. The spacers adjacent the cutting elements in the other stack may have a dual tapered profile to interleave with the adjacent cutting elements. The cutter teeth may be formed such that the cutter teeth have their maximum diameter at a center of the cutting element with respect to an axial direction of the cutting element. The spacers adjacent the cutting elements in the other stack may be formed with a minimum diameter at a center of the spacers with respect to an axial direction of the spacers.

According to another aspect, the cutter teeth are formed such that the cutter teeth have their minimum diameter at a center of the cutting element with respect to an axial direction of the cutting element. The spacers adjacent the cutting elements in the other stack may be formed with a maximum diameter at a center of the spacers with respect to an axial direction of the spacers.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

An aspect of this application is to provide improved cutters and spacers that consistently pierce or perforate and weaken dry and wetted fibrous waste water solids to facilitate tearing into short strips. This is accomplished using: 1) tooth profiles that incorporate serrations on the cutter teeth, or 2) tooth profiles that incorporate geometry that interleaves all or a portion of the cutter teeth with the opposing spacer. Additional embodiments describe interleaving designs using cutters with a V-shaped interface of cutter to spacer.

Figure 1A:
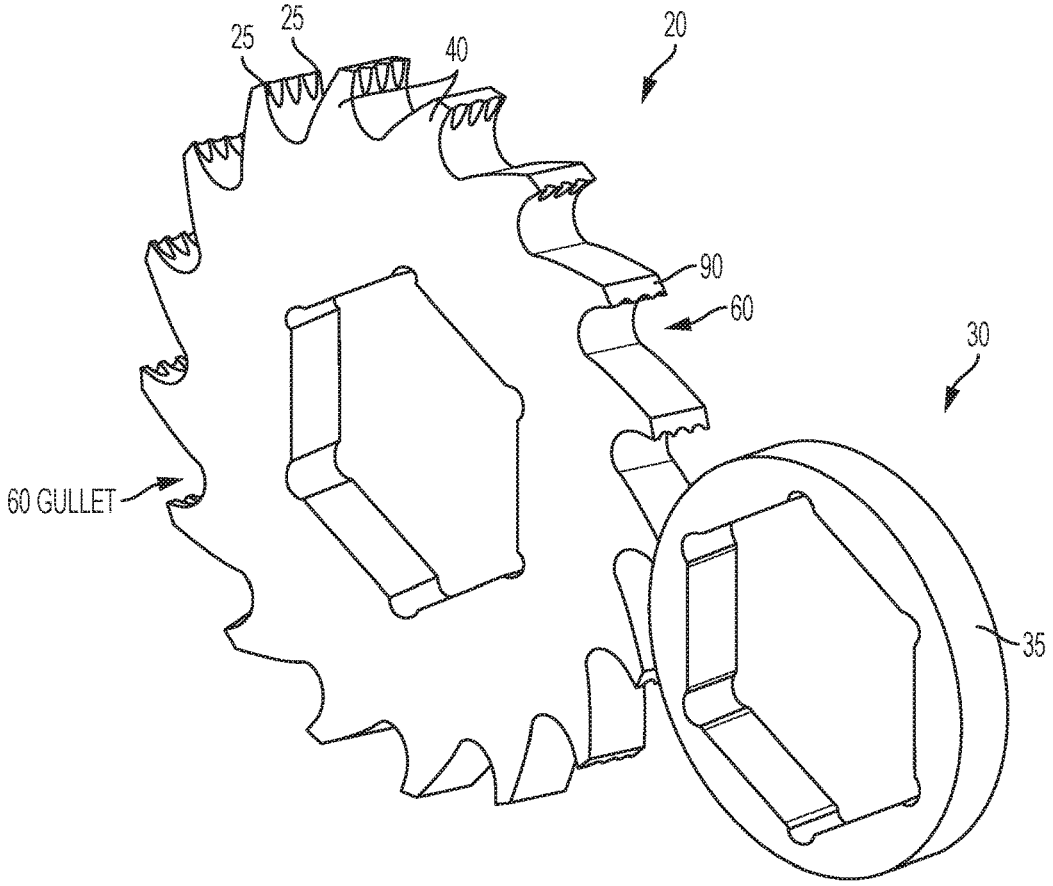
FIG. 1A is an isometric view of radially oriented serrations on the leading edge of cutters.
Figure 1B:
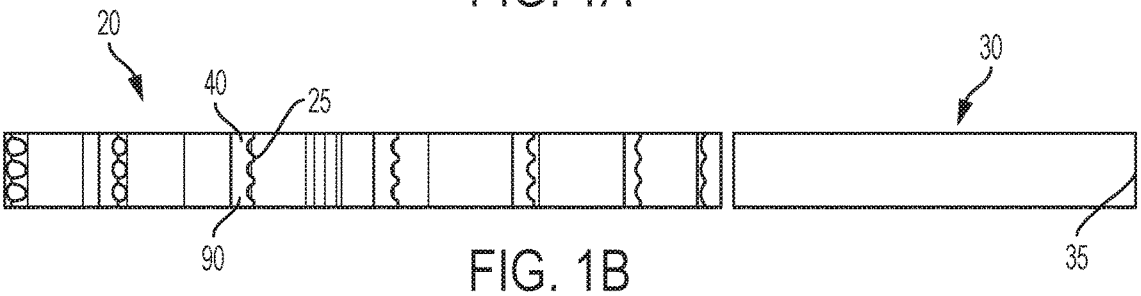
FIG. 1B is a top view of radially oriented serrations on the leading edge of cutters.
Figure 1C:
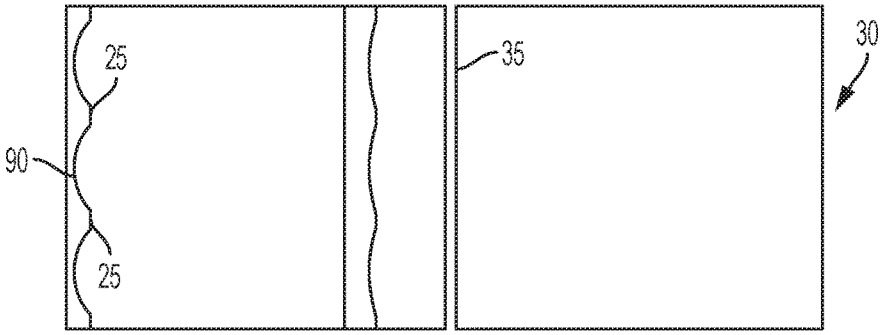
FIG. 1C is a close up view of radially oriented serrations on the leading edge of cutters at the cutter/spacer interface.

As shown in FIGS. 1A-1C, a first embodiment of the application describes a cutter 20 for use with a spacer 20 on an adjacent cutter stack. In the embodiment, the each cutter 20 is formed with a plurality of cutter teeth 40 disposed around the outer circumference of the cutter 20 body. During operation and when the adjacent stacks are rotating, the outer most portion of the cutter teeth 40, or lands 90, pass by the outer circumferential surface 35 of the spacer 30 to cut and shear solid waste material. As shown in these figures, the cutter teeth 40 have multiple serrations 25 on the leading edge of each cutter tooth 40 within the gullet 60 of the cutter 20. These serrations 25 are oriented radially from the center of the cutter 20 outward toward the land 90. The serrations 25 create an effective tearing surface to perforate and tear fibrous solids into shorter strips. The cutters 20 of this embodiment are configured to operate with spacers of cylindrical outer profile.

Figure 2A:
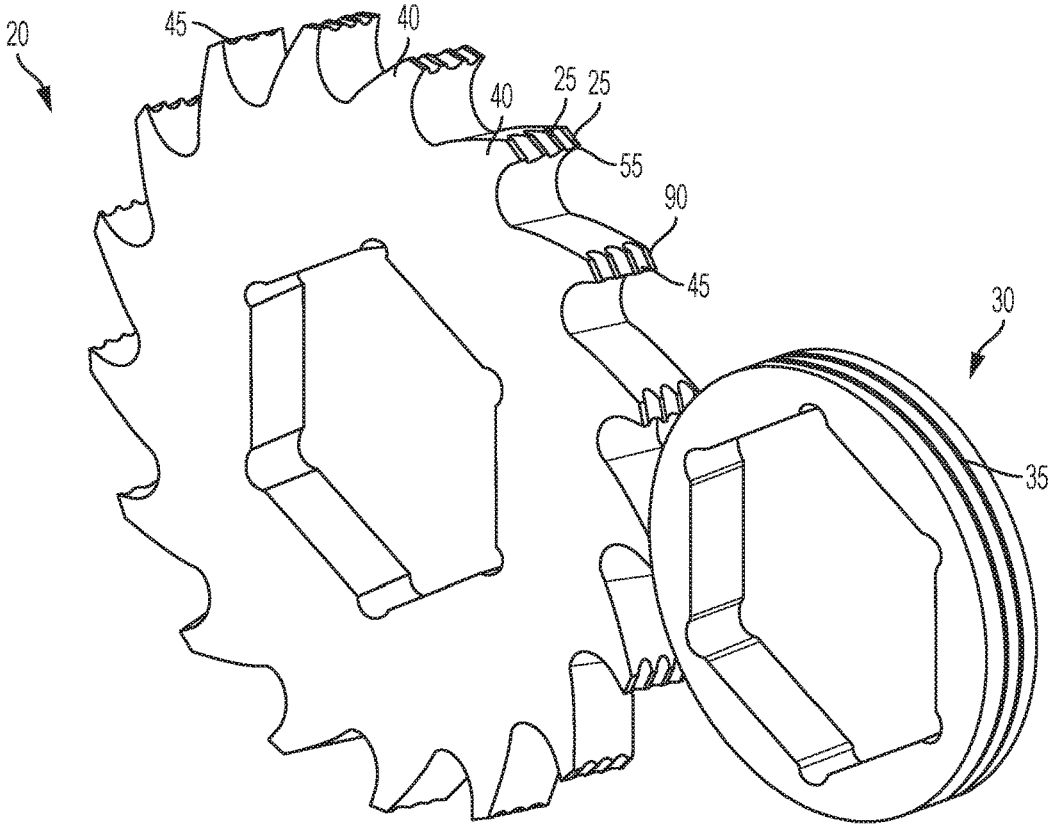
FIG. 2A is an isometric view of circumferentially oriented serrations on the leading edge of cutters.
Figure 2B:
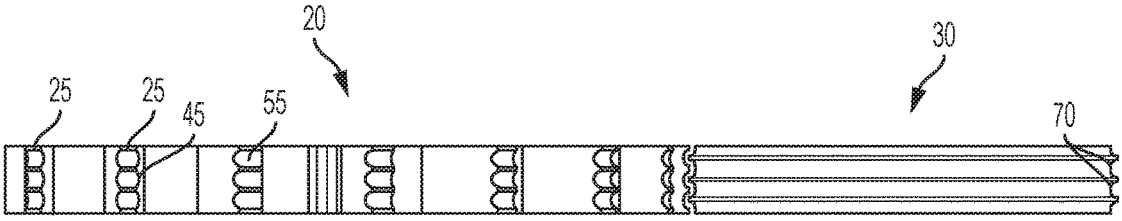
FIG. 2B is a top view of circumferentially oriented serrations on the leading edge of cutters.
Figure 2C:
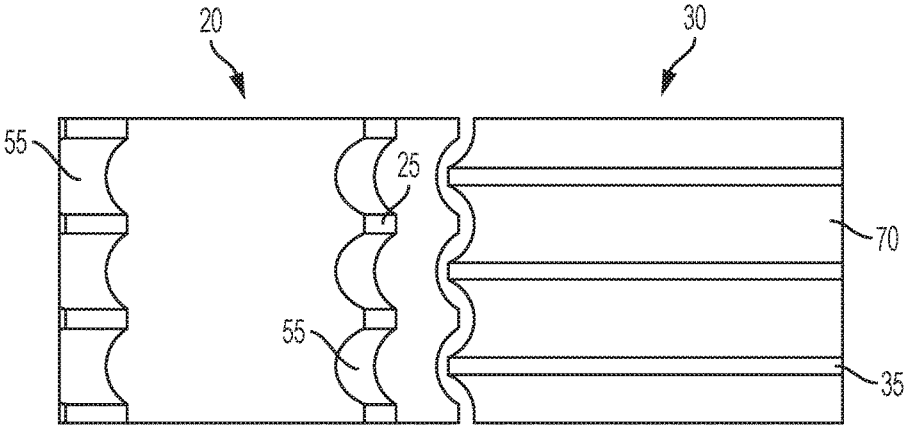
FIG. 2C is a close up view of circumferentially oriented serrations on the leading edge of cutters and interleaving spacer interface.

According to a second embodiment as shown in FIGS. 2A-2C, the cutter teeth 40 of the cutter 20 can have multiple serrations 25 formed on the leading edge 45 of each cutter tooth 40 and along the land surface 90. That is, in this embodiment, the serrations 25 are oriented circumferentially around the outer diameter of the cutter teeth 40. In addition to serrations 25 at the leading edge 45 of each cutter tooth 40, the circumferential serrations 25 also create a grooved surface 55 at the outer diameter portion of the cutter teeth 40. Additionally, the abutting spacer 30 is formed with a plurality of grooves 70. Thus, the grooved surface 55 at the outer diameter portion of the cutter teeth 40 interleaves with cylindrical spacers having similar grooves 70 along the spacer 30 to create an approach interface which facilitates the perforating and tearing of fibrous materials into shorter strips.

Figure 3A:
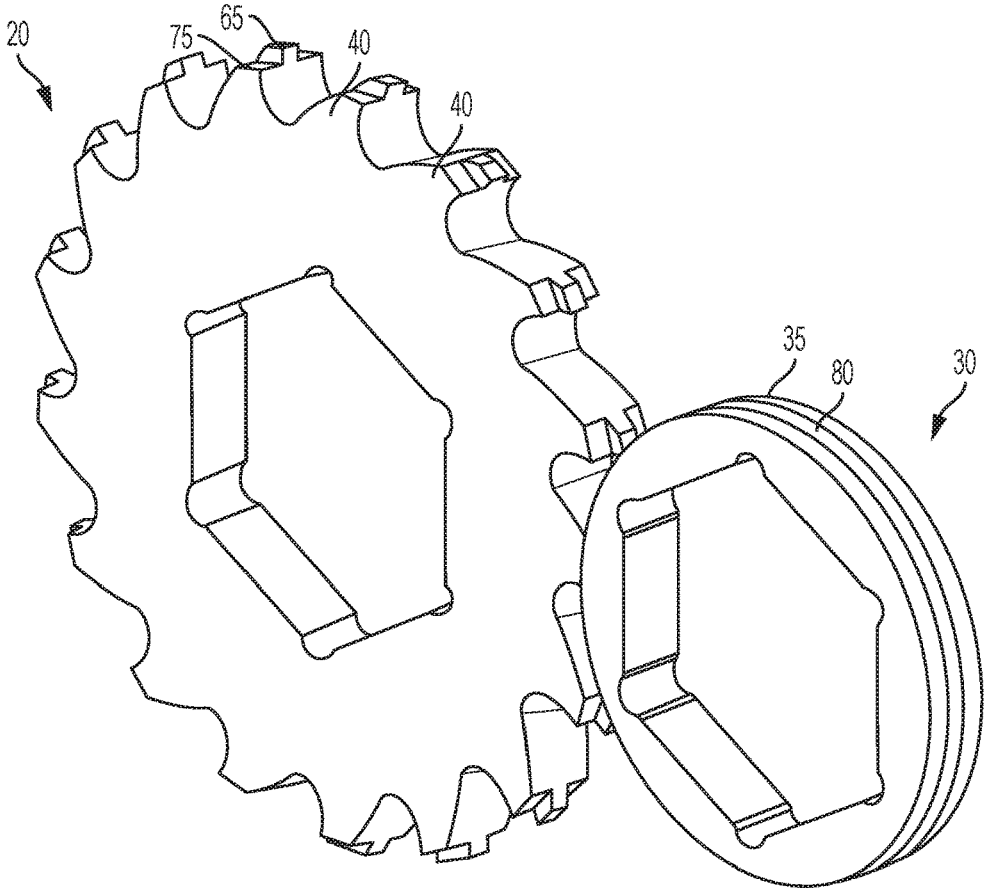
FIG. 3A is an isometric view of an interleaving cutter and spacer.
Figure 3B:
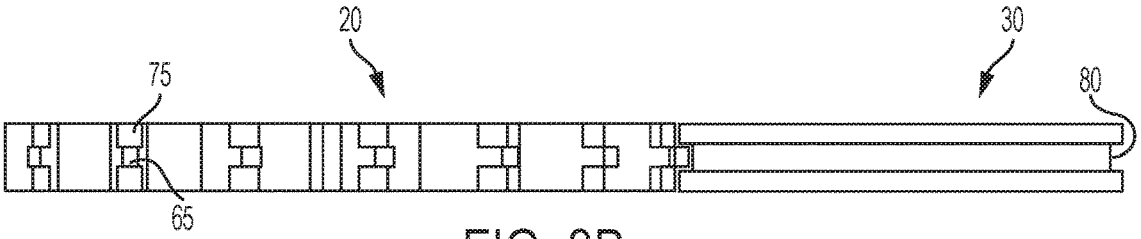
FIG. 3B is a top view of an interleaving cutter and spacer.
Figure 3C:
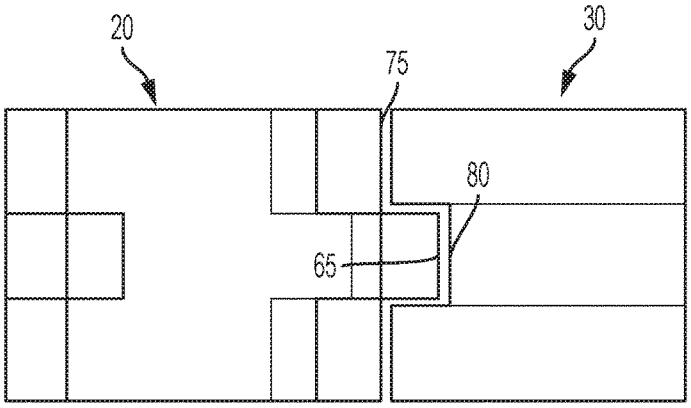
FIG. 3C is a close up view of an interleaving cutter and spacer interface.

In another embodiment as shown in FIGS. 3A-3C, the cutter 20 is formed with cutter teeth 40 having a bi-level height such that each cutter tooth 40 has a radially outward facing outer surface 65 and a radially outward facing inner surface 75. In this embodiment, each of these surfaces has a cylindrical profile. Additionally, this bi-level profile of the cutter 20 is configured to interleave with a cylindrical spacer 30 having a groove 80 of a similar mating profile. Thus, the groove 80 is formed to a profile similar to the portion of the cutter tooth 40 forming the outer surface 65 while the inner surface 75 is configured to approach the outer surface 35 of the spacer 30. The interleaving action of the cutter and spacer perforates fibrous materials to weaken, thus facilitating the tearing into shorter strips.

Figure 4A:
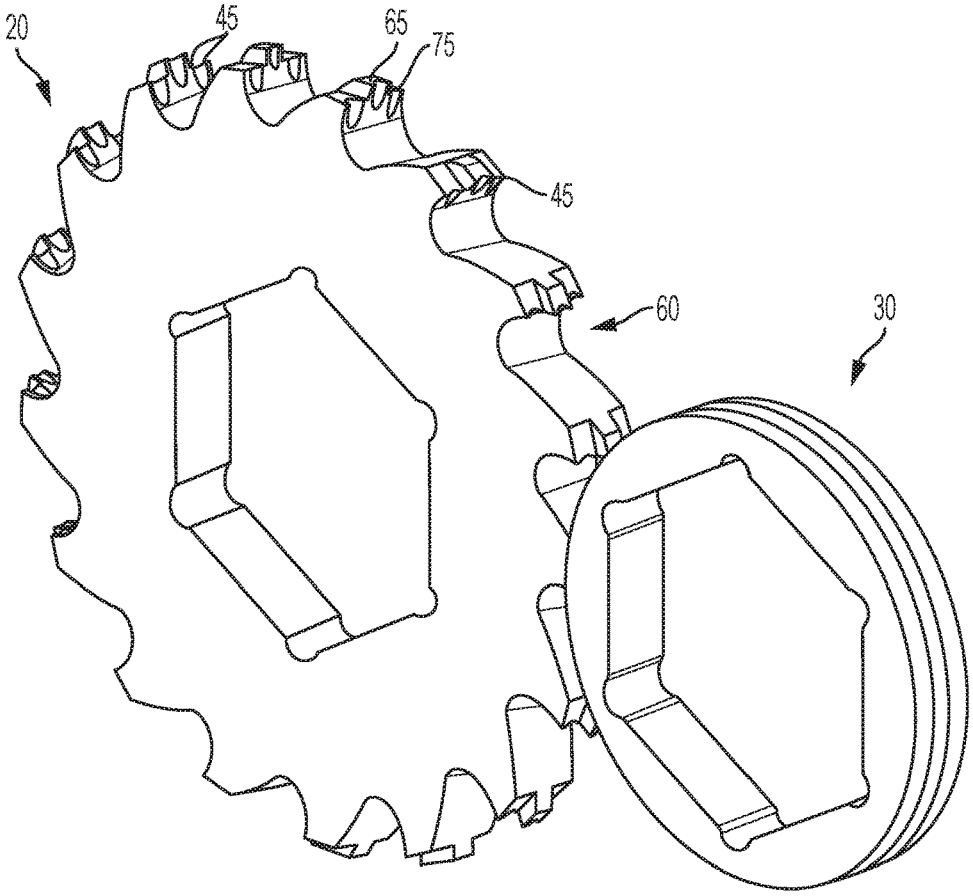
FIG. 4A is an isometric view of a combination serrated and interleaving cutter and spacer.
Figure 4B:
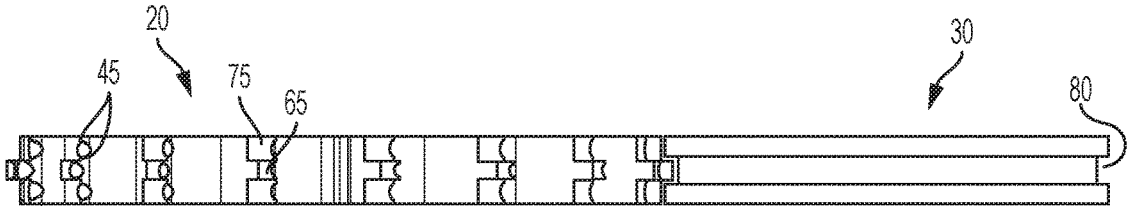
FIG. 4B is a top view of a combination serrated and interleaving cutter and spacer.
Figure 4C:
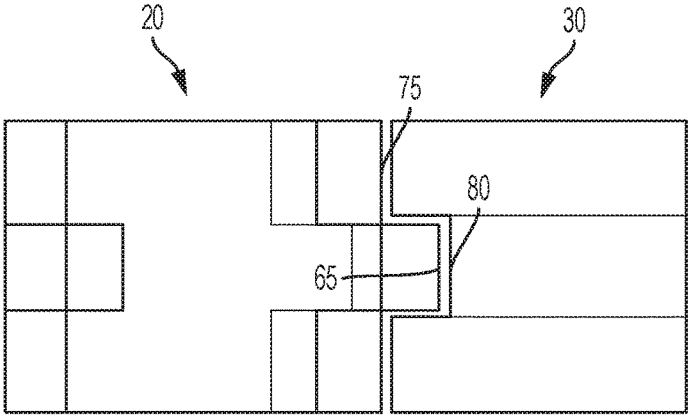
FIG. 4C is a close up view of a combination serrated and interleaving cutter and spacer—cutter/spacer interface.

In yet another embodiment as illustrated in FIGS. 4A-4C, in addition to the bi-level structure of FIGS. 3A-3C, the cutter teeth 40 of the cutter 20 are formed with multiple serrations 25 on the leading edge 45 of each cutter tooth 40. These serrations 25 are oriented radially from the center of the cutter 20 outward within the gullett 60. Additionally, all cutter teeth 40 are of bi-level height in which at least one raised portion 65 at the outer diameter of interleaves with a cylindrical spacer 30 having a groove 80 of similar mating profile. The combination of the serrations 25 and interleaving action of the cutter and spacer perforates fibrous materials to weaken, thus facilitating the tearing into shorter strips.

Figure 5A:
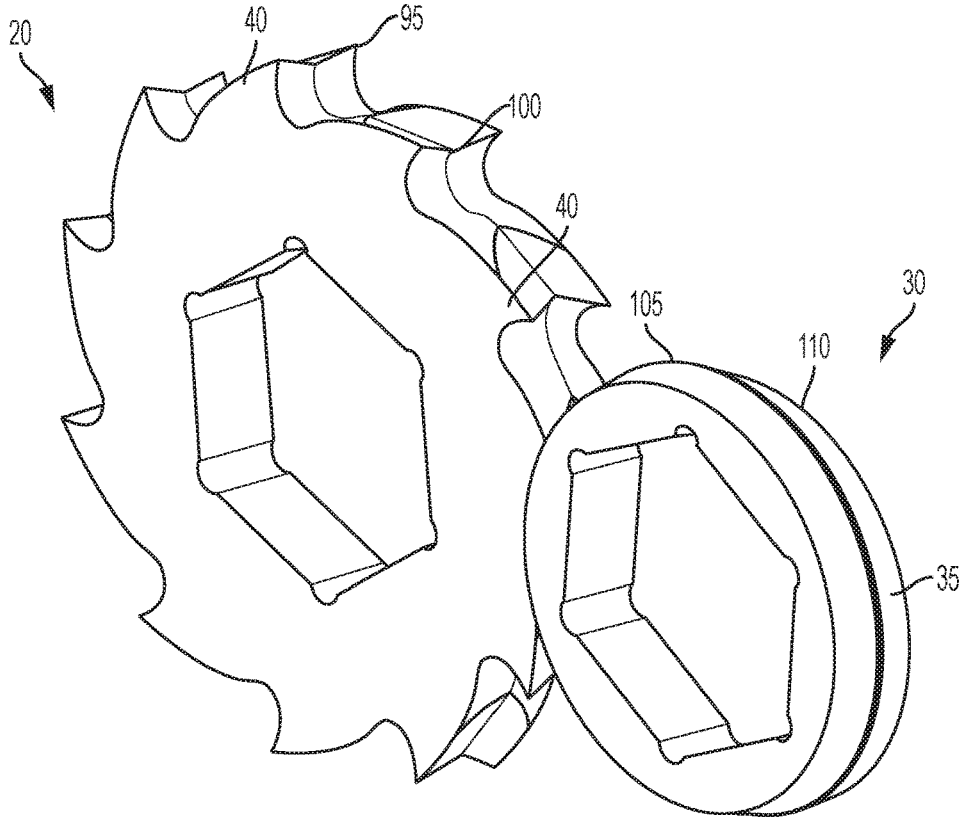
FIG. 5A is an isometric view of an interleaving V-profile cutter and spacer.
Figure 5B:
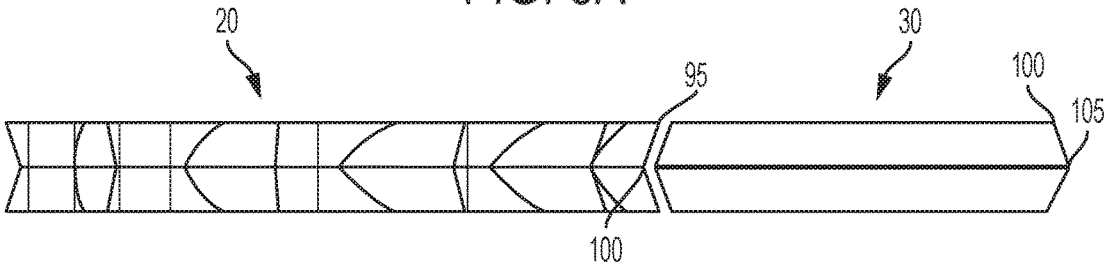
FIG. 5B is a top view of an interleaving V-profile cutter and spacer.
Figure 5C:
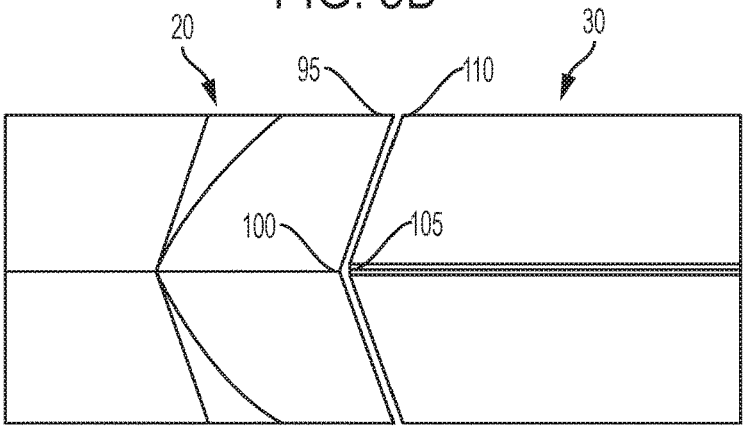
FIG. 5C is a close up view of an inverted interleaving V-profile cutter and spacer—cutter/spacer interface.

In another embodiment as illustrated in FIGS. 5A-5C, the cutter teeth 40 are formed in a tapered shape such that the cutter 20 has its maximum outer diameter 95 at the outer sides and its minimum outer diameter 100 at the center of the cutter 20 with respect to the axial direction of the cutter 20. Conversely, the spacer 30 is formed with a dual-tapered outer surface 35 such that the spacer 30 has its greatest outer diameter 105 at the center of the spacer 30 and a minimum outer diameter 110 at the outer sides with respect to the axial direction of the spacer 30. The shape may be a formed in a V-shaped profile. This V-shaped interface of the cutter 20 and spacer 30 facilitates edge perforation and weakening to facilitate tearing. The cutter 20 and the spacer 30 can be made either as a one-piece type or two piece type by mating mirror images arranged next to each other.

Figure 6A:
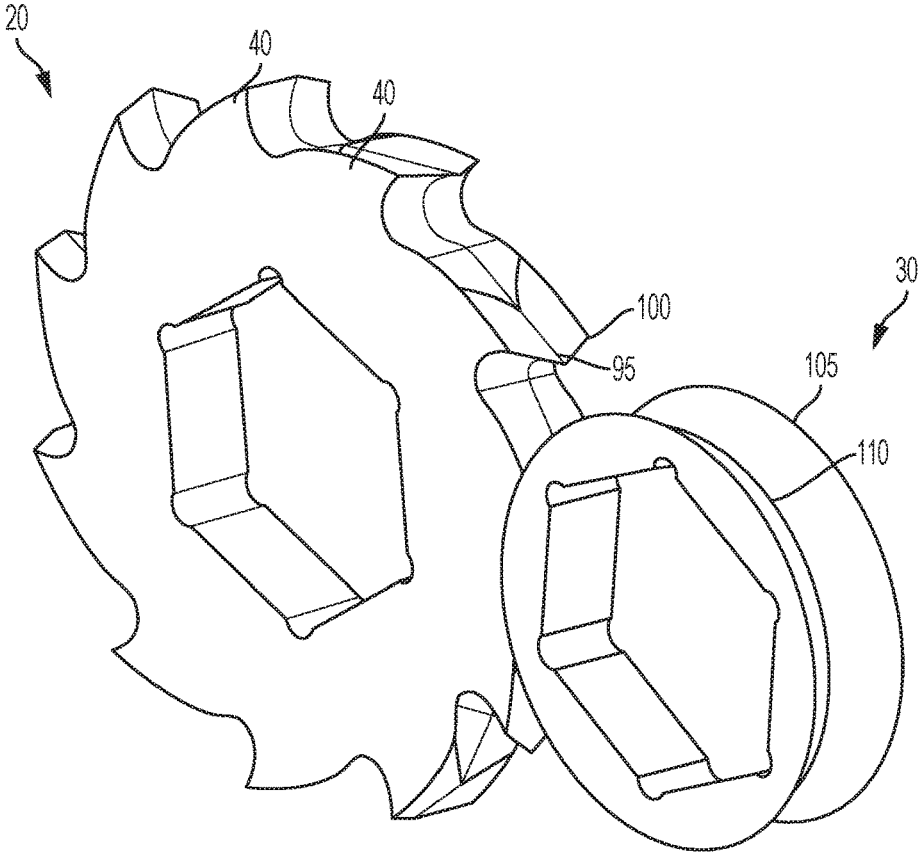
FIG. 6A is an isometric view of an inverted interleaving V-profile cutter and spacer.
Figure 6B:
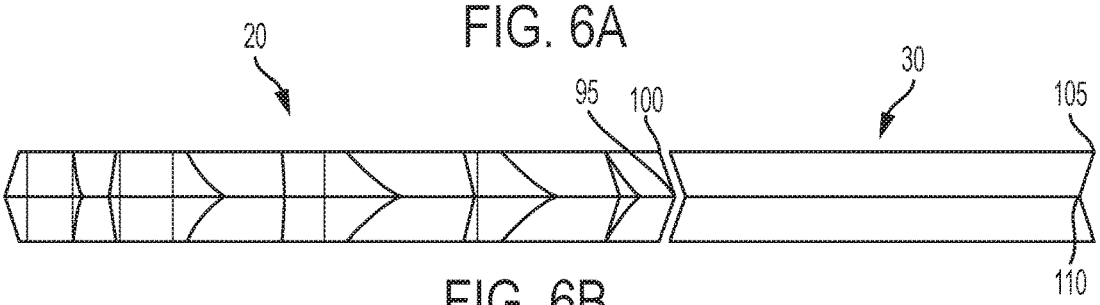
FIG. 6B is a top view of an inverted interleaving V-profile cutter and spacer.
Figure 6C:
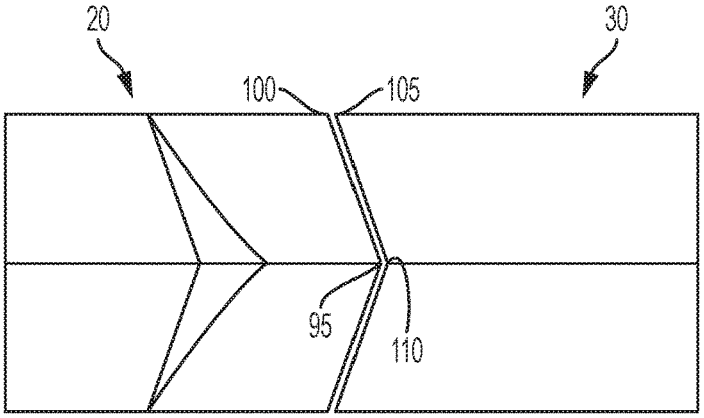
FIG. 6C is a close up view of an inverted interleaving V-profile cutter and spacer—cutter/spacer interface.
Figure 7:
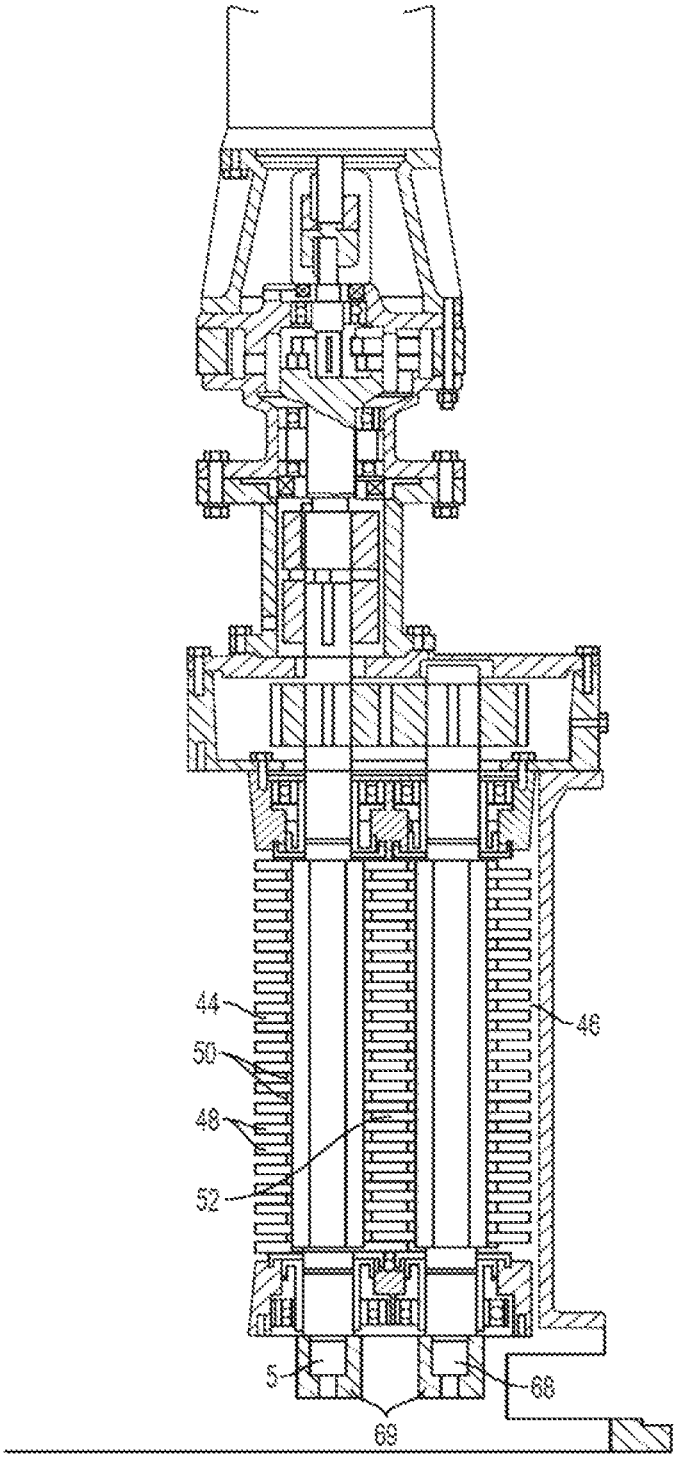
FIG. 7 PRIOR ART
FIG. 7 is a comminuting system in the related art.

In another embodiment as shown in FIGS. 6A-6C, the cutter teeth 40 are formed in a shape such that the cutter 20 has its maximum outer diameter 95 at the center of the cutter 20 and its minimum outer diameter 100 at the outer sides of the cutter 20 with respect to the axial direction of the cutter 20. Conversely, the spacer 30 is formed with a dual-tapered outer surface 35 such that the spacer 30 has its greatest outer diameter 105 at the outer sides of the spacer 30 and a minimum outer diameter 110 at the center of the spacer 30 respect to the axial direction of the spacer 30. This arrangement is an inversion of the previously described arrangement that is shown in FIGS. 5A-5C. Again, this V-shaped interface of the cutter 20 and spacer 30 facilitates center perforation and weakening to facilitate tearing. The cutter 20 and the spacer 30 can be made either as a one-piece type or two piece type by mating mirror images arranged next to each other.

What is claimed is:

1. An apparatus for comminuting solid waste material comprising:

a casing defining a comminution chamber and being open on opposite sides thereof for permitting a flow of liquid therethrough bearing solid waste material and being adapted for connection in a solid waste disposal line;

a comminutor assembly including cooperating parallel first and second shredding stacks comprising:

first and second parallel shafts rotatably mounted, each including a plurality of cutting elements mounted on said first shaft interspaced with a plurality of second cutting elements mounted on said second shaft, each of said cutting elements having at least one cutting tooth thereon, said cutting elements being positioned between and separated in an axial direction by spacers which are coplanar with the cutting elements of the adjacent stack such that each cutting element from one stack is coplanar with one spacer from the other stack to form a pair of interactive shredding members, wherein the at least one cutting tooth has at least one serration formed on a radially outer facing surface that is on a radial outermost surface of the at least one cutting tooth, and the at least one serration extends in a circumferential direction or a radial direction.

2. The apparatus for comminuting solid waste material according to claim 1, wherein the at least one serration is formed on leading edge of the at least one cutting tooth and extends along a gullet of the at least one cutting tooth.

3. The apparatus for comminuting solid waste material according to claim 2, wherein the spacers adjacent the cutting elements in the other stack have a cylindrical outer profile.

4. The apparatus for comminuting solid waste material according to claim 1, wherein the at least one serration is formed on an outer circumferential surface of the cutting teeth of the cutting elements to extend along the outer circumferential surface.

5. The apparatus for comminuting solid waste material according to claim 4, wherein the spacers adjacent the cutting elements in the other stack are formed with at least one groove configured to interleave with a corresponding at least one serration formed along the outer circumferential surface of the cutting teeth of the cutter elements.

6. The apparatus for comminuting solid waste material according to claim 1, wherein a maximum length of each serration extends in either the circumferential direction or the radial direction.

* * * * *